United States Patent [19]

Scharf et al.

[11] 4,312,941

[45] Jan. 26, 1982

[54] PHOTOGRAPHIC MATERIALS WITH ANTIHALATION MEANS BASED UPON SILVER HALIDE EMULSIONS

[75] Inventors: Martin Scharf, Köthen; Ulrich Meisel, Dessau, both of German Democratic Rep.

[73] Assignee: VEB Filmfabrik Wolfen, Wolfen, German Democratic Rep.

[21] Appl. No.: 154,249

[22] Filed: May 29, 1980

[30] Foreign Application Priority Data

May 31, 1979 [DD] German Democratic Rep. ... 213280

[51] Int. Cl.[3] ..... G03C 1/84

[52] U.S. Cl. ..... 430/510; 430/512; 430/518; 430/537; 430/941

[58] Field of Search ..... 430/518, 537, 941, 961, 430/510

[56] References Cited

U.S. PATENT DOCUMENTS

| | | | |
|---|---|---|---|
| 3,048,487 | 8/1962 | Minsk et al. | 430/518 |
| 3,619,194 | 11/1971 | Mitchell | 430/510 |
| 3,876,429 | 4/1975 | Poppe et al. | 430/518 |

*Primary Examiner*—J. Travis Brown

*Attorney, Agent, or Firm*—Jordan and Hamburg

[57] ABSTRACT

The present invention is directed to a photographic material based upon silver halide emulsions comprising an emulsion layer containing a diffusible dye, and an antihalation layer containing a mordant for fixing the diffusible dye superimposed directly over the emulsion layer, the antihalation layer having its maximum degree of absorption in the same spectal range as the maximum degree of sensitivity of the emulsion layer.

12 Claims, No Drawings

PHOTOGRAPHIC MATERIALS WITH ANTIHALATION MEANS BASED UPON SILVER HALIDE EMULSIONS

BACKGROUND OF THE INVENTION AND PRIOR ART STATEMENT

The invention relates to photographic materials based upon silver halide emulsions with an antihalation layer for improvement of the definition.

The technique of adding light absorbing substances (dyestuffs, uv-absorbers) to photographic materials in order to absorb unwanted light of certain ranges of the spectrum in order to obtain an improvement of the definition and/or the color rendition is known. Substances of this kind are referred to hereabelow as filtering dyes and may be used either immediately in the emulsion or in specific filtering layers of the photographic material. They may be divided as to their placement as follows, in which DE-OA and DE-AS mean Federal Republic of Germany Offenlegungsschrift and Auslegeschrift, respectively.

(a) Reflection-antihalation layers

They are always on the surface of the emulsion layer(s), facing away from the source of radiation, either between the emulsion and the support or on the rear side of the support. Their function is to absorb as much as possible all radiation which has penetrated the emulsion layer(s) and which is reflected by the optical interfaces, gelatine/support or support/air, respectively, in order to prevent blur by the so-called reflection halo. Examples may be found in DE-OS No. 2,771,220. Therefore, the ideal color of these layers is black. In other words, they should have an intensive, even absorption across the whole visible spectrum. Various different embodiments of this idea are known, but each such photographic material contains only one antihalation layer.

(b) Dyeing of the emulsion layers.

Here the filtering dyes are added immediately to the emulsion in order to absorb light scattered by the silver halide crystals and to prevent thereby the so-called "diffusion halo" which also causes considerable losses of definition. The amount of dyeing corresponds to the sensitivity of the individual layer and leads to considerable losses of sensitivity and gradation. One material may contain several dyes.

(c) Intercalated filter layers in multiple layer materials

These layers serve as well for the improvement of color rendition and to an improvement of definition. Viewed from the source of radiation, they are always disposed underneath the layer whose definition they should improve and act thus as an anti-halation agent in the sense of (a) above as well as a protection against light scattered by silver halide crystals of the layer lying underneath, which aids in the lowering of the diffusion halo. Simultaneously, they improve the color rendition of the emulsion layer disposed underneath by preventing undesired exposure to spectral ranges outside the sensitivity range intended for data presentation. Therefore the filtering inter-layer should absorb as much as possible in this area of interfering side-sensitivity but should not absorb any light in the special area where the maximal sensitivity of the emulsion layer lies which, viewed from the source of irradiation, is disposed underneath the filter-layer. An important example is the yellow filter layers of color materials which correct the undesired blue-sensitivity of emulsion layers which are sensitized for green or red light, respectively. Another example is red interlayers between the red-sensitive and green-sensitive layers of color materials as mentioned, for instance, in DE-OS No. 2,453,217. The latter expressly points out the need for maximum transparence for red light for which the layer lying underneath the filtering layer is sensitized. Similar examples may be found in DE-OS No. 2,711,220. A material may contain a plurality of inter-layers.

(d) Coatings for protection against darkroom light

In order to improve working conditions while manufacturing, processing, copying and developing photographic materials, interested groups constantly endeavor to illuminate darkrooms as brightly as possible with light of certain wavelengths. This is based upon the premise that the materials show no sensitivity at that wavelength. Frequently, though, the films show a certain side-sensitivity also in the range of the darkroom illumination. For these conditions, the film may be coated with a protective layer and/or the emulsion may be dyed, as proposed for instance by DE-OS 2,119,718. Here it is important to absorb potentially all light of the darkroom illumination without increasing simultaneously the absorption in the spectral range of the maximum sensitivity.

(e) Coatings protecting against uv-light

Azomethine-dyes are slowly destroyed by high-energy irradiation, particularly by uv-light. In order to prevent this undesired effect, a coating may be used containing uv-absorbers as proposed, for instance, by DE-AS No. 1,153,249. In this case also, the absorption of the filtering layer lies not in the spectral range where the underlying emulsion layer is designed to record light and where it possesses its highest sensitivity.

It is possible to use a combination of various dying procedures according to (a) to (e) in one material.

The above described methods result in a noticeable improvement of color rendition and definition but they show one considerable disadvantage. The scattering of light and its reflection are not completely prevented even when combining reflection antihalation with layer-dyeing and/or dyed interlayers, so that unsharp contours are shown particularly at places in an image that show great differences of brightness. Increasingly intensive dyeing of the emulsion layers is capable of reducing this unwanted effect but, simultaneously, the sensitivity of the photographic material is greatly reduced. Due to the fact that the light travels a substantially increased path caused by the scattering action of the silver halide crystals in the layer, the optical density influencing sensitivity is about twice as high as the sensitivity measured on transversal view. In other words, dyeing at $D=0.30$ leads to a sensitivity loss of about two stops. Because optical density is a function of the depth of penetration and thus a function of the amount of arriving light, the dyeing of the emulsion also leads to flattening of gradation and to a non-linear shape of the characteristic curve. This reasoning shows clearly that scattered and reflected light can be removed in a limited way only by dyeing of the layers when the sensitometric parameters are fixed beforehand.

The object of the invention is to create photographic materials with an improved rendition of details, particularly crispening of contours and high sensitivity.

The invention is based upon absorbing as much as possible scattered light particularly by judicious localization of the filtering dyes within the layer packet, without impairing sensitivity and gradation.

This problem is surprisingly solved by coating the surface of the photographic material facing towards the irradiation to be recorded with an additional antihalation layer which absorbs mainly in that spectral area where the emulsion layer disposed immediately underneath possesses its maximum sensitivity, said antihalation layer showing in its absorption maximum a density of at least 0.10. In the case of multilayer materials, the antihalation layers of the invention are dyed so that they possess their highest absorption in the area of the maximum sensitivity of both uppermost emulsion layers, when viewed from the source of irradiation.

For color films, the optical density of the antihalation coating of the invention is at least 0.10 when measured at the sensitivity maximum of the green-sensitive layer, and is 30 to 100% of the optical density in the green area of the spectrum; and is at least 0.05 when measured at the sensitivity maximum of the second layer.

For the dyeing of the layer, all conventional diffusion proof filtering dyes or dyes made diffusion proof by appropriate mordants as well as their mixtures may be used, which dyes absorb in the above-named areas of absorption. In a preferred embodiment, the emulsion layer or layers, respectively, contain easily diffusing, water-soluble filtering dyes for diffusion antihalation and, to the antihalation coating, a mordant is added at such a dosage that a dye distribution with optimal antihalation effect is obtained by the fixing of the filtering dyes which diffuse from the emulsion layer(s). It is possible to determine empirically or by performing simulator programmed calculations aided by mathematical layer models the optimal relation between the dye(s) in the emulsion and in the antihalation coating and the concentration of mordant resulting therefrom. The amount of dye for the coloring of the antihalation coating of the invention is thus extracted from the emulsion layers and leads thereby to a considerable increase of definition without increasing the amount of dye and that only by the change of the dye distribution or dye localization in the layer packet. Addition of mordants to the coating is often accompanied by additional advantages, for instance an increase of conductivity or other physicomechanical properties.

The antihalation coatings of the invention may also contain additives generally used for coatings. They may, for instance, contain wetting agents, hardeners, plasticizers, antistatic agents, antioxidants, uv-absorbers, clarifiers and stabilizers. It is also possible to add means for roughening the surface, as this has a very beneficial influence upon the dyeing of the coating. An advantage of the invention is the improvement of the rendition of detail, particularly of the sharpness of the contours of photographic materials. When using multiple layer materials, mainly the sharpness of the emulsion layer disposed immediately under the coating is improved; improvement may also be seen in the next deeper lying layer, but farther removed emulsion layers do not show any practically relevant differences. The materials of the invention are obviously superior, as far as sharpness is concerned, to the materials of the present state of the art, as shown for instance in DE-OS No. 2,453,217 and DE-OS No. 2,711,220. The invention is particularly advantageous for color films where the sharpness-determining gree-sensitive layer is, as viewed from the light source, the first layer of emulsion, as for instance in color-positive materials with a transposed sequence of layers. An important advantage of the invention is the fact that no flattening of the gradation and no change of form of the characteristic curve of the photographic material occurs in contradistinction to the methods of coloring of the emulsion. A characteristic advantage of the embodiment described later, which changes only the distribution of dye while keeping the overall dyeing constant, consists in obtaining a higher sensitivity, which is based upon the shorter path of light within the antihalation-coating relative to the light path in the emulsion layers.

Another advantage is that the materials of the invention may be obtained at small expense and by using additives which are conventionally used in the manufacture of films and also without changing the structure and the processing of photographic films. The antihalation-coatings of the invention differ from the reflection-antihalation layers (a) and the filtering interlayers (c) according to the state of the art by their position in the layer packet. While the layers according to (a) and (c) are always disposed below emulsion layers, as viewed from the light source, the new antihalation coatings of the invention lie above all emulsion layers as the uppermost layer. The antihalation-coatings of the invention differ from dyed emulsion layers according to (b) by containing no silver halide. The antihalation-coatings of the invention differ from coatings for the increase of darkroom safety (d) or for protection against uv-light (e) as well as from intercalated filtering layers for improved color rendition (c) according to the state of the art by their specific spectral absorption. The maxima of coloring of the antihalation-coatings of the invention lie exactly in those spectral regions where the coatings according to the state of the art (c, d, e,) are unable to absorb light, i.e., in the region of the maximum sensitivity of the emulsion layers disposed underneath them. This is expressly indicated, for instance, in DE-OS No. 2,119,718 and 2,453,217.

Due to the differing color sensitivities of the human eye, lack of sharpness of the green-sensitized layer is particularly disturbing. Therefore, it is particularly advantageous to color very strongly color films in the region of green sensitization.

The effect of the antihalation layers of the invention is based upon the absorption of light, backscattered by the silver halide crystals of the emulsion layer(s) onto the film surface and reflected there at the optical air/-binder interface. This scattered light intrudes, in film materials according to the state of the art, into the emulsion layer(s) and produces there, at a considerable distance from its point of entrance, an exposure which is perceived as a lack of sharpness.

Of all differing possibilities to dye with filtering dyes according to the state of the art, this backreflected scattered light is reduced only by dyeing of the emulsion layers (b). The effect of such a process is very small because the scattered light, backreflected by the film surface, acts mainly in the uppermost partial region of the emulsion layer, whereby a very small part of the dyeing of the emulsion becomes effective.

The antihalation top coating is preferentially used in addition to the conventional dyeing methods according to the state of the art; the materials of the invention thus possess all the advantages of materials according to the state of the art and, furthermore, the above named advantages due to the additional antihalation protection at the surface of the material. The antihalation top coatings may, of course, be used alone, if so desired.

DETAILED DESCRIPTION OF PREFERRED EMBODIMENTS

Examples

Example 1

A substrate is coated on both sides with a basecoat, then by known methods with NC-layer (reflection-antihalation layer) containing per 1 kg gelatine 75 g of the dye

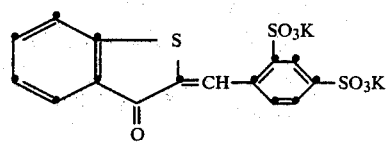

according to U.S. Pat. No. 2,072,908 and also an appropriate wetting agent and a hardener. The NC-layer is 9.8 μm thick. The dye application of 900 mg/m² yields an optical density of 1.02 at 460 nm.

An unsensitized silver bromide emulsion is applied to the opposite side of the substrate with a maximum of light sensitivity at 460 nm. The emulsion contains per kg 1.2 g Tartrazine (color index 19140) as a dye for antihalation and also appropriate wetting agents and hardeners. The layer thus applied contains 2.75 g/m² silver; the layer is 8.6 nm thick and contains within the emulsion layer 135 mg/m² dyestuff resulting in an optical density of the filtering dye of 0.40 at 460 nm.

Next a gelatine topcoat $O_A$ is applied containing an appropriate wetting agent and hardener and is 1.35 μm thick. The specimen thus produced (A) represents the state of the art and serves for comparison.

Similarly a specimen B is made, where the dyeing of the NC-layer (reflection-antihalation layer) on the rear side of the substrate is increased by 50% so that the optical density of the NC-layer at 460 nm amounts to 0.152 corresponding to a dye coating of 1350 mg/m².

Specimen C is prepared analogously to specimen A, but the dyeing of the emulsion is increased by approximately 50% so that the material possesses in the emulsion layer a dyestuff application of 200 mg/m² and an optical density of filtering dye of 0.59 (measured in transverse view at 460 nm).

Specimen D demonstrates the advantages of the invention. It is prepared analogously to specimen A but, instead of a simple gelatine topcoat $O_A$, an antihalation layer $O_D$ is applied over the emulsion layer. The topcoat is 1.4 μm thick and contains, per 1 kg gelatine, 50 g of a diffusion fast dyestuff of the formula

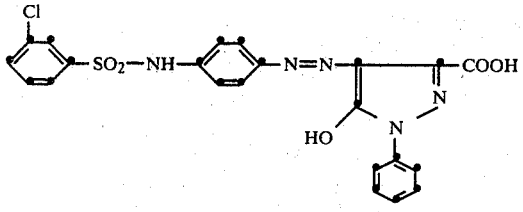

according to DD-PS No. 107,990 and also an appropriate wetting agent and a hardener. The maximum of absorption of the antihalation layer lies at 458 nm and equals therefore exactly the maximum of sensitivity of the emulsion layer. The optical density is 0.12. All other parameters of the specimen, particularly the amount of silver per square meter and the optical density of the emulsion layer and also the optical density of the NC-layer are exactly as in specimen A. (DD-PS means German Democratic Republic patent.)

Specimen E also demonstrates the advantages of the invention. It is prepared analogously to specimen A, but is furnished with the topcoat $O_E$ instead of the topcoat $O_A$. Topcoat $O_E$ contains per 1 kg gelatine 100 g of a polymeric mordant E, having the formula

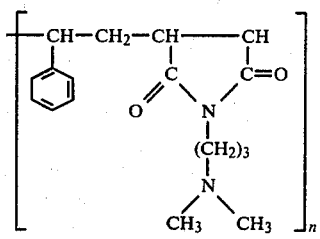

according to U.S. Pat. No. 3,048,487, and appropriate wetting agents and hardeners. The topcoats are 1.45 μm thick. In the time space while the coatings are applied and drying, Tartrazin diffuses into the topcoat $O_E$ thereby fixing a definite amount of dyestuff in the topcoat. Subsequent separate determinations of the diffusion-proof dyestuff and of the freely diffusing dyestuff, as described in DD-PS No. 119,323, example 2, give for the antihalation layer a dye deposition of 44 mg/m² corresponding to an optical density (460 nm) of 0.13 and for the emulsion layer a content of free diffusable dyestuff (Tartrazin) of 91 mg/m², corresponding to an optical density (transversely measured) of 0.27. The sum of both values (135 mg/m²) corresponds to the dye deposition on the emulsion side of specimen A. Silver deposition/m² and dye deposition of the NC-layer are identical for materials A and E.

Rendition of detail is judged according to TGL 26 408/02 by a determination of resolution. Sensitometric properties are determined by neutral wedge Factor 2, analogous to TGL 143/408.

The procedure in both cases is according to ORWO-method 1100 (G. Huebner, W. Krause publishers, ORWO-Rezepte, Wolfen 1978).

The results are presented in table 1. They show that materials according to the invention effect an improvement of resolution, while the sensitivity is only negligibly reduced (material D) and the preferred method (E) even increases the sensitivity. On the other hand, the conventional method (material B) does not improve sharpness when the conventional method of dye increase in the reflection-antihalation layer is used; increased dyeing of the emulsion leads to increased sharpness only at great losses of sensitivity.

Example 2

Specimen F is prepared according to the state of the art in order to serve as a comparison material herebelow:

A cellulose-triacetate substrate, provided with a basecoat and on its backside with a light-exclusion lacquer of optical density 1.0 (reflection antihalation layer), is coated by a known method with a sensitized silverbromide emulsion, containing per kg emulsion 18 g yellow coupler F 535 (BIOS Final Report 721,22; 1946) and also an appropriate stabilizer, a wetting agent and a hardener. Silver application is 1.2 g Ag/m², the layer is 6.4 μm thick, and the maximum of sensitivity lies at 450 nm. This emulsion layer is topped with a red-sensitive silver chloride bromide emulsion containing per kg emulsion 15 g bluegreen coupler F 546 (BIOS Final Report 721,23; 1946), 30 mg red-sensitizer Rr 1953 (BIOS Final Report 721, 10; 1946), 7 g green diffusable dye CI Acid Green 1 (Col. Index 10020), and also an appropriate stabilizer, a wetting agent and a hardener. Silver application is 0.7 g/m², the layer is 3.9 μm thick, application of filtering dyestuff is 150 mg/m², corresponding to a density of filtering dye of 0.18 (measured transversely at 700 nm), and the maximum of red sensitivity also lies at 700 nm.

This layer is topped with a third emulsion layer, containing green-sensitive silver chloride bromide with per kg emulsion: 18 g magenta coupler 1-(4-phenoxy-3-sulfo-phenyl) 3-stearoylamino-pyrazolone-(5), 20 mg green sensitizer Rr 340 (BIOS Final Report 721, 7; 1946) with a maximum of green sensitivity at 550 nm, 3.3 g of a magenta filtering dye of formula

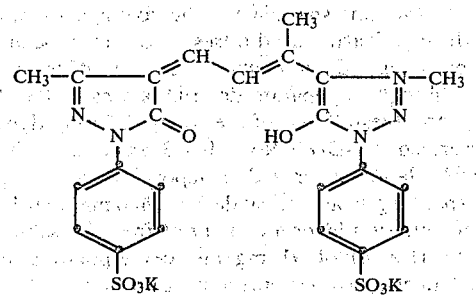

according to BP No. 515,998, also stabilizer, wetting agent and hardener. Silver application of the green sensitive layer is 0.5 g Ag/m², the layer is 3.5 μm thick and filtering dye is 50 mg/m² corresponding to a density of filtering dyestuff equal to 0.33 (measured transversely at 550 nm).

A hardened gelatine layer $O_F$, 0.9 μm thick, forms the top layer.

Specimen G shows the advantages of the invention. It is prepared analogously to the material F except for a topcoat $O_G$ instead of topcoat $O_F$. $O_G$ contains per kg gelatine 54 g mordant I from example 1, material E, and furthermore wetting agents and hardeners.

The topcoat is 1.0 μm thick, the mordant is applied at 70 mg/m². This amount of mordant was determined by preliminary experiments. Diffusion from the emulsion layers of the green and the magenta dyes, which are fixed by the mordant in the topcoat, produces a dyed antihalation topcoat. The dyestuff is analyzed as in example 1. The antihalation topcoat contains 75 mg/m² green dye, and 19 mg/m² magenta dye, both indiffusably fixed. Absorption of the topcoat antihalation layer is 0.13 at 550 nm and 0.09 at 700 nm. 75 mg/m² green dye and 31 mg/m² magenta dye remain diffusible in the emulsion layers, corresponding to an optical density (transverse) of 0.20 at 550 nm and 0.09 at 700 nm. Sharpness is judged by the K-number according to FRIESER (TGL 28 157). The sensitivity was determined according to TGL 143/408. Processing is performed according to ORWO-Vorschrift 7182 (G. Huebner/W. Krause Publishers, ORWO Rezepte, Wolfen 1978).

Results can be found in table 2. The material has slightly higher gradation and sensitivity values and a considerable improvement of sharpness of the green layer and also of the red layer.

Example 3

The experiments of example 2 were repeated, using higher concentrations of dyes.

Specimen H, prepared according to the state of the art, corresponds completely to material F but contains in its red-sensitive center-layer 13.2 g CI Acid Green 1 per kg emulsion. Application of dyestuff is 285 mg/m², corresponding to an optical density (transverse at 700 nm) of 0.34. When applying the green-sensitive overcoat, 6.2 g magenta dye of example 2 were added per kg emulsion. Application is 95 mg magenta dye/m², corresponding to an optical density (measured transversely at 550 nm) of 0.62.

Specimen I corresponds in all parameters, including strength of coloring, to material H but does possess a topcoat $O_I$, which contains per kg gelatine 60 g mordant E from example 1, besides all of the conventional addition agents. The topcoat is 1.0 μm thick and the mordant is laid down at 78 mg/m². 22 mg magenta dye and 83 mg green dye are fixed to be diffusion proof corresponding to an optical density of 0.15 at 550 nm and 0.10 at 700 nm. Analysis and evaluation are as in example 2. The results are presented in table 2. It is obvious that material I has visibly better sharpness, with noticeable low diminution of sensitivity, than the Material H dyed with the same amount of dyes according to the state of the art. Higher gradation values were also found.

TABLE 1

| Specimen | Relative Sensitivity | Resolution in Lines/mm |
|---|---|---|
| A | Typ | 200 |
| B | −0.10 | 200 |
| C | −0.35 | 220 |
| D | −0.10 | 230 |
| E | +0.10 | 220 |

TABLE 2

| Material | Relative Sensitivity | | | Gradation | | | k-Number According to FRIESER | | |
|---|---|---|---|---|---|---|---|---|---|
| | b | g | r | b | g | r | b | g | r |
| F | Typ | Typ | Typ | 3.1 | 3.0 | 3.0 | 58 | 37 | 51 |
| G | = | +0.1 | +0.1 | 3.1 | 3.1 | 3.2 | 59 | 28 | 46 |
| H | −0.15 | −0.3 | −0.2 | 3.0 | 2.7 | 2.8 | 51 | 21 | 39 |
| I | −0.1 | −0.15 | −0.1 | 3.0 | 2.9 | 3.0 | 51 | 14 | 36 |

What is claimed is:

1. A photographic material based upon silver halide emulsions, comprising (A) an emulsion layer containing at least one diffusible filtering dye and possessing maximum degree of sensitivity in a spectral range, and (B) an antihalation layer disposed immediately over said emulsion layer, (1) having a maximum degree of absorption in the spectral range of the maximum sensitivity of said emulsion layer, (2) having an optical density of at least 0.10 in the spectral range of the maximum sensitivity of said emulsion layer, and (3) containing at least one mordant in an amount suitable for fixing dye diffusing into said antihalation layer from said emulsion layer.

2. The material of claim 1 wherein said antihalation layer comprises an amount of mordant to fix about 20 to about 50% of the total concentration of dye within said antihalation layer.

3. The material of claim 1 wherein said antihalation layer comprises an amount of mordant to obtain optical densities of about 0.10 at about 550 nm and about 0.08 at about 700 nm in said antihalation layer.

4. The material of claims 1 or 2 comprising (A) at least one other layer besides said emulsion and antihalation layers, (B) at least one diffusible magenta dye, and (C) at least one diffusible blue-green dye;

the amount of dye not fixed within said antihalation layer remaining freely movable throughout the other layers of said material.

5. The material of claim 1 wherein the amount of dye in said emulsion layer provides a concentration of dye fixed by mordant in said antihalation layer of about 91 to about 200 mg/m$^2$.

6. The material of claim 5 wherein said dye fixed by suitable mordant in said antihalation layer is tartrazine.

7. The material of claim 1, wherein said antihalation layer contains about 50 g. per kg of gelatine of dye of the formula

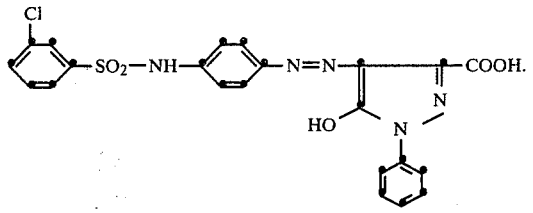

8. The material of claim 7 wherein said antihalation layer is about 1.0 to about 1.4 μm thick.

9. The material of claim 1, wherein said antihalation layer contains about 54 g. to about 100 g. per kg of gelatine of a polymeric mordant of the formula

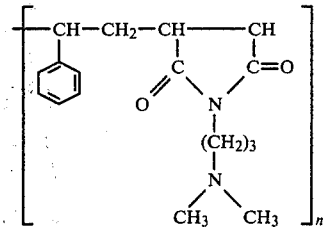

for fixing suitable dye diffusing into said antihalation layer from said emulsion layer.

10. The material of claim 1, wherein said antihalation layer provides a concentration of dye fixed by suitable mordant of about 44 mg/m$^2$.

11. The material of claim 1, wherein said antihalation layer provides a concentration of mordant of about 70 to about 78 mg/m$^2$ for fixing suitable dye diffusing into said antihalation layer from said emulsion layer.

12. The material of claim 1 wherein said antihalation layer additionally comprises at least one component selected from the group consisting of wetting agents, hardeners, plasticizers, antistatic agents, antioxidants, uv-absorbers, clarifiers, stabilizers, and mixtures thereof.

* * * * *